United States Patent [19]

Block

[11] 4,251,896

[45] Feb. 24, 1981

[54] FLOOR MACHINE WITH GIMBALLED BRUSH DRIVE

[75] Inventor: Thomas S. Block, Muskegon, Mich.

[73] Assignee: Clarke-Gravely Corporation, Muskegon, Mich.

[21] Appl. No.: 49,876

[22] Filed: Jun. 19, 1979

[51] Int. Cl.[3] ..... A47L 11/162

[52] U.S. Cl. ..... 15/49 R; 51/177

[58] Field of Search ..... 15/28, 29, 49 R, 50 R, 15/98, 87, 385; 51/177

[56] References Cited

U.S. PATENT DOCUMENTS

| | | | |
|---|---|---|---|
| 1,650,690 | 11/1927 | Cavicchi | 15/49 R |
| 1,870,232 | 8/1932 | Brim | 15/49 R |
| 2,007,073 | 7/1935 | Clarke | 15/49 R |
| 2,291,740 | 8/1942 | Menkhaus . | |
| 2,561,279 | 7/1951 | Holt . | |
| 3,011,190 | 12/1961 | Wilke . | |
| 3,216,047 | 11/1965 | Ernolf | 15/49 R X |
| 3,401,416 | 9/1968 | Ziegler . | |
| 3,428,984 | 2/1969 | Collier . | |
| 3,512,204 | 5/1970 | Jagier . | |
| 3,562,843 | 2/1971 | Belicka et al. | 15/49 R X |
| 3,600,735 | 8/1971 | Jerabek . | |
| 3,860,989 | 1/1975 | Johnston | 15/49 R |
| 4,012,805 | 3/1977 | Schneider . | |
| 4,096,599 | 6/1978 | Mayo . | |

*Primary Examiner*—Edward L. Roberts

*Attorney, Agent, or Firm*—Price, Heneveld, Huizenga & Cooper

[57] ABSTRACT

The specification discloses a floor treating machine in which a vertical axis rotating brush is coupled to the motor through a motor gimbal having convex bottom and side walls which are seated in a cavity within a receiving brush gimbal, the bottom and side walls of the cavity having radii greater than the radii of the motor gimbal bottom and side wall so that the brush is free to shift its axis of rotation vis-a-vis the axis of rotation of the motor gimbal to thereby accommodate deviations in the surface being cleaned.

16 Claims, 7 Drawing Figures

FLOOR MACHINE WITH GIMBALLED BRUSH DRIVE

BACKGROUND OF THE INVENTION

The present invention relates to floor treating machines which utilize a rotating brush or like element wherein the rotating element rotates about a generally vertical axis. Normally, the brushes provided are removable from a drive member which in turn is connected to a drive motor.

A snap type of connection is disclosed in the patent to Ziegler No. 3,401,416 which issued on Nov. 15, 1966. A more common means for removably securing a brush to the drive member involves providing the drive member with a cog or teeth which pass through a notch in a drive plate which is mounted to the brush. One then rotates the brush so that the cog locks into position behind flanges on the drive plate. Examples of such arrangements are disclosed in Wilke U.S. Pat. No. 3,011,190 which issued Dec. 5, 1961, Jagiel U.S. Pat. No. 3,512,204 which issued May 19, 1970, Jerabek U.S. Pat. No. 3,600,735 which issued Aug. 24, 1971, Holt U.S. Pat No. 2,561,279 which issued July 17, 1951 and Collier U.S. Pat. No. 3,428,984 which issued Feb. 25, 1969.

One problem with such arrangement is that as the operator drives the machine or moves the machine over deviations in the floor, the pressure between the rotating brush and the floor becomes uneven. A proper cleaning job is not accomplished. Such uneveness can also result if the weight of the machine is shifted somehow, for example when the machine is turned around corners or perhaps even as solution from a solution tank on one side of the machine is used up and becomes collected in a recovery tank on the other side of the machine.

SUMMARY OF THE INVENTION

The present invention obviates this prior art difficulty through the use of a gimballed connection between the rotating brush and the brush drive motor. A motor gimbal having a convex bottom surface is operably connected to the drive motor and is seated in a receiving cavity in a brush gimbal which in turn is secured to a floor treating brush. Means are provided for releasably securing the motor gimbal in place within the cavity. Means are also provided on the motor gimbal and brush gimbal for fixing the same such that they rotate together when the drive motor is operated. The convex bottom surface of the motor gimbal is radiused to a shorter radius than the interior bottom wall of the brush gimbal cavity so that as the machine traverses a surface being cleaned, the floor treating brush is free to shift its axis of rotation vis-a-vis the axis of rotation of the motor gimbal.

These and other objects, advantages and features of the invention will be more fully understood and appreciated by reference to the written specification and appended drawings.

DESCRIPTION OF THE PREFERRED EMBODIMENT

Figure 1:
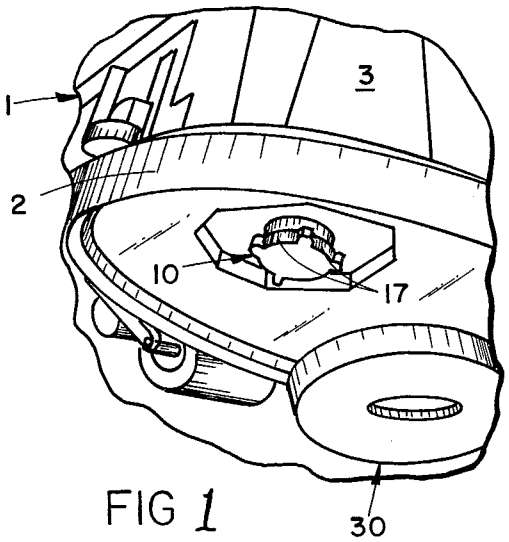
FIG. 1 is a floor level perspective view of a portion of a floor treating machine which shows the brush housing, a brush drive motor and one of the brushes in place with the other one removed.
Figure 2:
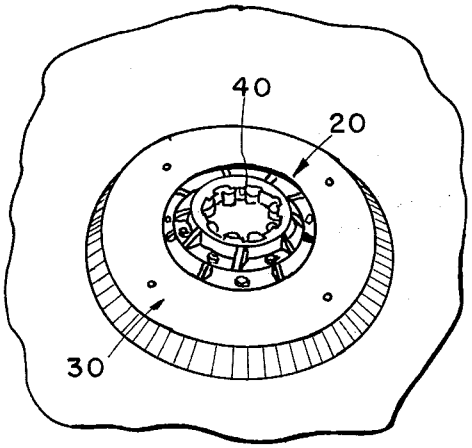
FIG. 2 is an elevated perspective view of a brush including a brush gimbal.

FIG. 1 shows a floor treating machine 1 having a large brush housing 2 for housing two vertical axis rotating brushes 30. A motor 3 is mounted on top of brush housing 2. Motor gimbal 10 is operably secured to the drive output shaft of motor 3. A brush 30 shown in place on the opposite side of brush housing 2 can be releasably secured to motor gimbal 10 by means of brush gimbal 20 which is bolted to brush 30 (FIG. 2).

Motor gimbal 10 and brush gimbal 20 are both made of a self-lubricating plastic material such that they can movably rub against one another without binding up. A preferred plastic material comprises 33% glass reinforced 6/6 nylon. The tensile strength of the material is 11,000 psi at 73° F. The yield strength is the same. Compressive strength is 29,000 psi in accordance with ASTM test D-695. Deformation under 4,000 psi at 122° F. (ESTM D-621) is approximately 1.3%.

Figure 5:
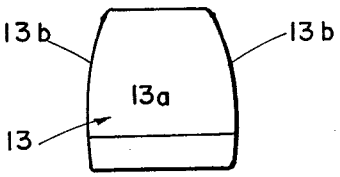
FIG. 5 is an end elevational view of a motor gimbal cog.
Figure 4:
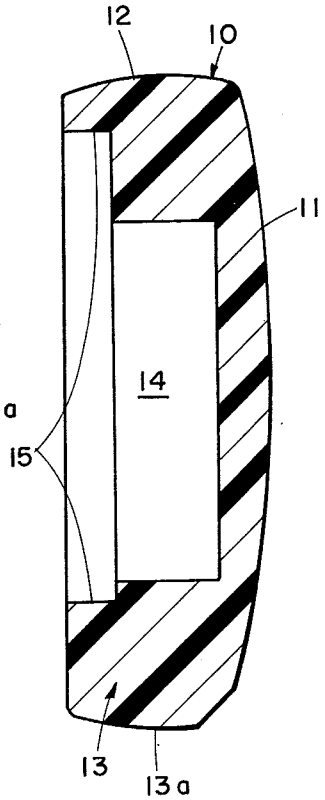
FIG. 4 is a cross sectional view taken along plane IV—IV of FIG. 3.
Figure 3:
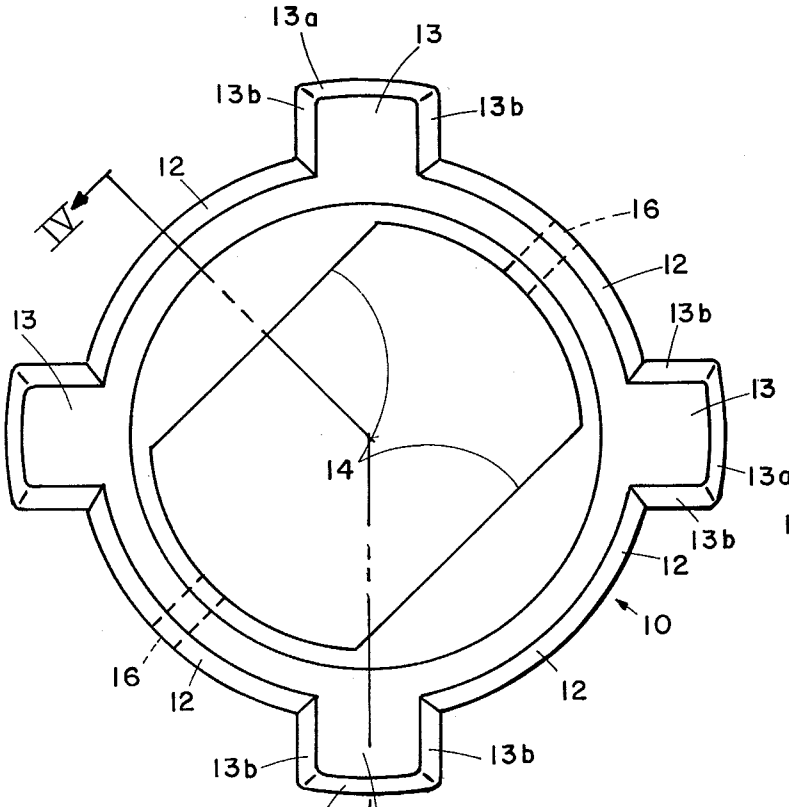
FIG. 3 is a top plan view of a motor gimbal.

It is also preferred that the plastic material of motor gimbal 10 and brush gimbal 20 be resistant to chemical deterioration in highly alkaline solution. In fact, the detergent solutions which are dispensed by floor treating machine 1 are dispensed through motor gimbal 10 and brush gimbal 20 in such a way that they actually assist in lubrication between the two parts. And, it is important to the gimbal action between motor gimbal 10 and brush gimbal 20 that the two can freely shift relative to one another without binding Motor gimbal 10 has a convex, spherical bottom surface 11 (FIG. 4). It also has convex side walls 12 extending upwardly therefrom with four regularly spaced cogs 13 projecting from side walls 12 (FIGS. 3 and 4). Cogs 13 have an end wall 13*a* which is convex and side walls 13*b* which are convex (FIGS. 3, 4 and 5).

In the best mode currently known, convex bottom 11 is formed to a radius of 180 mm. Side walls 12 are formed to a 40 mm radius. The end walls 13*a* of cogs 13 are formed on a 50 mm radius. Side walls 13*b* are formed on a 40 mm radius.

Motor gimbal 10 also includes a hollow interior solution cavity 14 into which cleaning solution from the solution tank in machine 1 is fed. From thence, solution flows out by centrifugal force through cleaning solution holes 16 which pass through side walls 12 of motor gimbal 10.

Above solution cavity 14 is a shallower but wider recess 15 into which a mounting plate (not shown) on the end of the drive shaft of motor 3 is seated. Motor gimbal 13 is then secured in place by means of bolts 17 which pass up through bottom surface 11 and the body of motor gimbal 10 (through holes not shown) and then thread into the plate which is seated in recess 15. That plate is also provided with suitable openings such that cleaning solution will drain down into solution cavity 14.

Brush gimbal 20 includes a cavity 21 which opens upwardly for receiving motor gimbal 10. The cavity bottom wall 22 is a concave, spherical surface against which the convex bottom 11 of motor gimbal 10 seats. However, the radius of surface 22 is larger than the radius of motor gimbal bottom 11 so that brush gimbal 20 is free to shift its axis of rotation relative to the axis of rotation of motor gimbal 10. In the best mode currently known, the radius of concave surface 22 is 400 mm.

Cavity side walls 23 extend generally vertically upwardly from cavity bottom wall 22. In order to allow motor gimbal side walls 12 to sit relatively close to cavity side walls 23, it is necessary that the radii of cavity side wall of 23 be greater than the radii of motor gimbal side walls 12 to allow the brush gimbal 20 to shift its axis of rotation relative to motor gimbal 10. In the best mode currently known, the radius of side walls 23 is infinite, or in other words they are generally straight walls extending generally vertically upwardly from cavity bottom wall 22.

Cavity side walls 23 are interrupted at regularly spaced points by outwardly deviating notches 24 which are designed to receive cogs 13 on motor gimbal 12. Eight cog receiving notches 24 are provided in brush gimbal 20 so that brush gimbal 20 can readily be fitted onto motor gimbal 10 without having to be exceedingly fussy about proper orientation between the two.

The side walls 24*b* and the end wall 24*a* of each notch 24 are also generally straight and vertical, thereby having an infinite radius. They could have some curvature, just as cavity side wall 23 could have some curvature. It is important, however, that the radius of the inside wall of notches 24 be greater of the radii of the side walls 13*b* and end walls 13*a* of cogs 13, again to allow the gimbal action between motor gimbal 10 and brush gimbal 20.

When it is stated that the radius of a particular brush gimbal surface is greater than the radius of a particular motor gimbal surface, it is intended to include a situation where the radius of each given surface might vary over the total given area of the surface. In such a varying radius surface, it would only be important that the radii of a brush gimbal surface be greater at various points throughout the surface than the radius of generally corresponding points on the surface of the motor gimbal. In other words, the radii are selected to provide a varying distance between the exterior bottom surface of the motor gimbal and the interior bottom surface of the brush gimbal along a radius line from the center of rotation of the brush gimbal.

Figure 7:
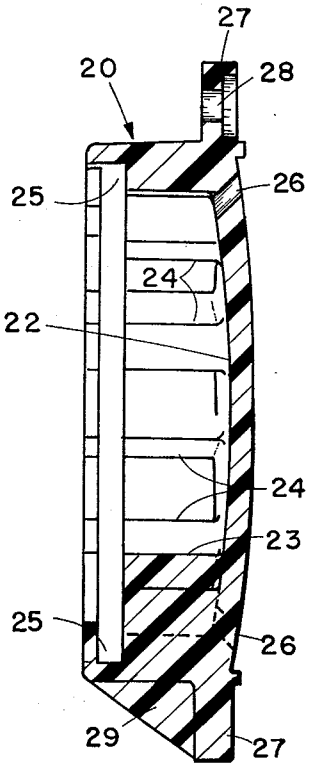
FIG. 7 is a cross sectional view taken along plane VII—VII of FIG. 6.
Figure 6:
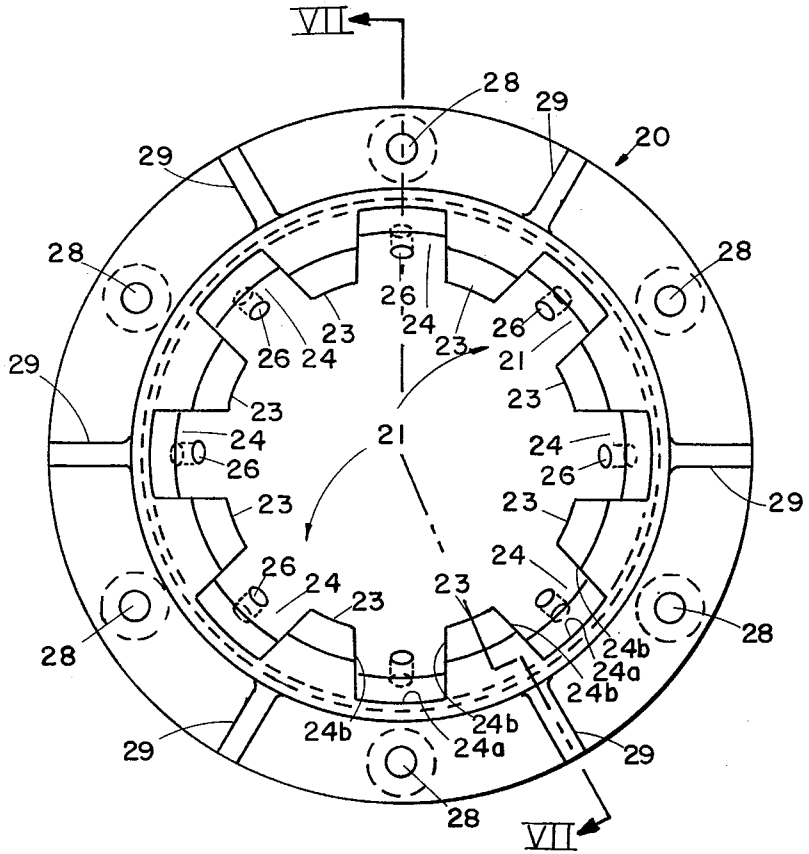
FIG. 6 is a top plan view of the brush gimbal.

Brush gimbal 20 also includes a groove 25 near the upper edge thereof (FIG. 7). A snap ring made of a material such as spring steel is fitted into snap ring groove 25. In order to secure brush 30 in place on motor gimbal 10, brush gimbal 20 is forced up over motor gimbal 10 with the snap ring 40 (not shown in FIG. 7 but partly visible in FIG. 2) expanding over the end walls 13*a* of cog 13. Then as cogs 13 passe into position with notches 24, snap ring 40 contracts and serves as a block to prevent cogs 13 from readily passing back out of notches 24. Passage can be forced, however, when one wants to remove brush 30 from motor gimbal 10.

Located in bottom wall 22 of cavity 21, generally within the confines of the notches 24, are solution drainage holes 26. These slope downwardly and outwardly through the bottom wall 22 of cavity 21 such that solution flowing into cavity 21 flows by centrifugal force into notch areas 24 and thence out through holes 26 into the area of bristles of brush 30. This serves not only as a means for feeding solution to the bristles of brush 30 but also provides a lubricating action for the engaging surfaces of cogs 13 and notches 24 particularly, as well as for the remaining engaging surfaces of motor gimbal 10 and brush gimbal 20 to some extent.

Projecting radially from the generally cup-shaped member defined by cavity bottom wall 22 and side walls 23 is a peripheral mounting flange 27 (FIG. 7). It includes bolt holes 28 therethrough which facilitate securance of brush gimbal 20 to the remainder of the body of brush 30. Also spaced peripherally around flange 27 are gussets 29 which serve to reinforce both mounting flange 27 and the upwardly projecting side walls of cavity 21.

In operation, brush 30 is lifted into position such that motor gimbal 10 is forced down past snap ring 40 into position within cavity 21 and brush gimbal 20. Snap ring 40 then prevents brush 30 from falling off motor gimbal 10. The cogs 13 are seated within notches 24 so that when brush drive motor 30 is operated, it rotates brush gimbal 20 and brush 30 as well as motor gimbal 10. As brush 30 rotates, it is free to shift its axis of rotation relative to the axis of rotation of motor gimbal 10 in that convex bottom surface 11 of motor gimbal 10 is free to shift or rock against the concave bottom surface 22 of cavity 21. Similarly side walls 12 of motor gimbal 10 are free to rock against side walls 23 of cavity 21 and the side walls 13*b* and end walls 13*a* of cogs 13 are free to rock against the side walls 24*a* and end walls 24*b* of brush gimbal cavity notches 24.

Brush 30 can therefore shift to accommodate deviations in the floor surface or to accommodate any shifting in weight of machine 1. This helps to insure an even brush pressure on the surface being cleaned.

Cleaning solution which is fed down into solution cavity 14 in motor gimbal 10 flows outwardly through solution apertures 16 and into cavity 21 in brush gimbal 20. From thence it flows by centrifugal force out through solution holes 26 and into the bristle area of brush 30. The presence of cleaning solution within cavity 21 helps lubricate the engaging surfaces of motor gimbal 10 and brush gimbal 20. This helps to insure that there will be no binding of same.

Of course, it is understood that the above is merely a preferred embodiment of the invention and that various changes and alterations can be made without departing from the spirit and broader aspects of the invention as defined by the appended claims, interpreted in accordance with principles of patent law.

The embodiments of the invention in which an exclusive property or privilege is claimed are defined as follows.

1. A floor treating machine including a brush drive motor, a floor treating brush for rotation about a generally vertical axis and means operably connecting said brush to said brush drive motor, the improvement in said floor treating machine comprising said means operably connecting said brush to said brush drive motor including: a motor gimbal having a convex exterior bottom surface, said exterior bottom surface having a radius of curvature; means operably connecting said motor gimbal to said drive motor; a brush gimbal; means mounting said brush gimbal on said floor treating brush; said brush gimbal including a cavity in the upper exposed surface thereof, said cavity having a bottom interior surface which has a radius of curvature; means releasably securing said brush gimbal to said motor gimbal with said motor gimbal seated in said brush gimbal cavity; means on said motor gimbal and on said brush gimbal fixing the same against rotation relative to one another such that they rotate together when said drive motor is operated; said exterior bottom surface of said motor gimbal having a radius of curvature substantially less than the radius of curvature of the bottom interior surface of said brush gimbal to provide a varying distance between said exterior and interior surfaces along a radius line from the center of rotation of said brush gimbal, said exterior bottom surface and said bottom interior surface being dimensioned so that as said floor treating machine traverses a surface being cleaned, said floor treating brush is free to shift its axis of rotation vis-a-vis the axis of rotation of said motor gimbal.

2. The floor treating machine of claim 1 in which said motor gimbal includes convex exterior side walls each having a radius of curvature and which are seated in close proximity to interior side walls in said brush gimbal cavity, each of said interior side walls having a radius of curvature; said convex exterior side walls of said motor gimbal having a radius of curvature shorter than the radius of curvature of said interior side walls of said brush gimbal cavity.

3. The floor treating machine of claim 2 in which said interior bottom surface of said brush gimbal cavity is concave.

4. The floor treating machine of claim 1, 2 or 3 wherein said means fixing said motor gimbal and brush gimbal against rotation relative to one another comprise cogs projecting radially outwardly on said motor gimbal and cog receiving notches deviating radially outwardly from the interior side walls of said brush gimbal cavity.

5. The floor treating machine of claim 4 in which each of said cogs comprises an end wall and spaced side walls having concave surfaces.

6. The floor treating machine of claim 1 in which said interior bottom suface of said brush gimbal cavity is concave.

7. The floor treating machine of claim 6 wherein said means fixing said motor gimbal and brush gimbal against rotation relative to one another comprise cogs projecting radially outwardly on said motor gimbal and cog receiving notches projecting radially outwardly from the interior side wall of said brush gimbal activity.

8. The floor treating machine of claim 7 in which each of said cogs comprises an end wall and spaced side walls having concave surfaces.

9. A floor treating machine including a brush drive motor, a floor treating brush for rotation about a generally vertical axis and means operably connecting said brush to said brush drive motor, the improvement in said floor treating machine comprising said means operably connecting said brush to said brush drive motor including: a motor gimbal having a convex exterior bottom surface, said exterior bottom surface having a radius of curvature; means operably connecting said motor gimbal to said drive motor; a brush gimbal; means mounting said brush gimbal on said floor treating brush; said brush gimbal including a cavity in the upper exposed surface thereof, said cavity having a bottom interior surface which has a radius of curvature; means releasably securing said brush gimbal to said motor gimbal with said motor gimbal seated in said brush gimbal cavity; means on said motor gimbal and on said brush gimbal fixing the same against rotation relative to one another such that they rotate together when said drive motor is operated; said bottom exterior surface of said motor gimbal having a radius of curvature less than the radius of curvature of the bottom interior surface of said brush gimbal whereby as said floor treating machine traverses a surface being cleaned, said floor treating brush is free to shift its axis of rotation vis-a-vis the axis of rotation of said motor gimbal, said means fixing said motor gimbal and brush gimbal against rotation relative to one another comprising cogs projecting radially outwardly on said motor gimbal and cog receiving notches deviating radially outwardly from the interior side walls of said brush gimbal cavity, each of said cogs comprising an end wall and spaced side walls having concave surfaces and wherein said cog end wall and side walls lie in close proximity to a corresponding end wall and side walls in the receiving notch, said cog end wall and side walls having radii of curvature which are shorter than the radii of curvature of said notch end wall and side walls.

10. The floor treating machine of claim 6 wherein said means releasably securing said motor gimbal to said brush gimbal comprises a snap ring seated in a receiving groove in said brush gimbal, said snap ring being configured such that it can be snapped forcibly over said motor gimbal.

11. The floor treating machine of claim 10 wherein said motor gimbal includes an interior solution cavity with holes passing therefrom to the exterior of said motor gimbal; said brush gimbal including holes passing from said interior cavity to the exterior thereof and to the bristles of said brush whereby solution is fed to said solution cavity of said motor gimbal and thence to said interior cavity of said brush gimbal and thence to the bristles of said brush.

12. The floor treating machine of claim 11 wherein said motor gimbal and said brush gimbal are made of a self lubricating plastic material.

13. The floor treating machine of claim 11 wherein said motor gimbal and said brush gimbal are made of a self lubricating plastic material.

14. A floor treating machine including a brush drive motor, a floor treating brush for rotation about a generally vertical axis and means operably connecting said brush to said brush drive motor, the improvement in said floor treating machine comprising said means operably connecting said brush to said brush drive motor including: a motor gimbal having a convex exterior bottom surface, said exterior bottom surface having a radius of curvature; means operably connecting said motor gimbal to said drive motor; a brush gimbal; means mounting said brush gimbal on said floor treating brush; said brush gimbal including a cavity in the upper exposed surface thereof, said cavity having a bottom interior surface which has a radius of curvature; means releasably securing said brush gimbal to said motor gimbal with said motor gimbal seated in said brush gimbal cavity; means on said motor gimbal and on said brush gimbal fixing the same against rotation relative to one another such that they rotate together when said drive motor is operated; said bottom exterior surface of said motor gimbal having a radius of curvature less than the radius of curvature of the bottom interior surface of said brush gimbal whereby as said floor treating machine traverses a surface being cleaned, said floor treating brush is free to shift its axis of rotation vis-a-vis the axis of rotation of said motor gimbal, said interior bottom surface of said brush gimbal cavity being concave, said means fixing said motor gimbal and brush gimbal against rotation relative to one another comprising cogs projecting radially outwardly on said motor gimbal and cog receiving notches projecting radially outwardly from the interior side wall of said brush gimbal activity, each of said cogs comprising an end wall and spaced side walls having concave surfaces and wherein said cog end wall and side walls lie in close proximity to a corresponding end wall and side walls in the receiving notch, said cog end wall and side walls having radii of curvature which are shorter than the radii of curvature of said notch end wall and said side wall.

15. A floor treating machine including a brush drive motor, a floor treating brush for rotation about a generally vertical axis and means operably connecting said brush to said brush drive motor, the improvement in said floor treating machine comprising said means operably connecting said brush to said brush drive motor including: a motor gimbal having a convex exterior bottom surface, said exterior bottom surface having a radius of curvature; means operably connecting said motor gimbal to said drive motor; a brush gimbal; means mounting said brush gimbal on said floor treating brush; said brush gimbal including a cavity in the upper exposed surface thereof, said cavity having a bottom interior surface which has a radius of curvature; means releasably securing said brush gimbal to said motor gimbal with said motor gimbal seated in said brush gimbal cavity; means on said motor gimbal and on said brush gimbal fixing the same against rotation relative to one another such that they rotate together when said drive motor is operated; said bottom exterior surface of said motor gimbal having a radius of curvature less than the radius of curvature of the bottom interior surface of said brush gimbal whereby as said floor treating machine traverses a surface being cleaned, said floor treating brush is free to shift its axis of rotation vis-a-vis the axis of rotation of said motor gimbal, and wherein said means releasably securing said motor gimbal to said brush gimbal comprises a snap ring seated in a receiving groove in said brush gimbal, said snap ring being configured such that it can be snapped forcibly over said motor gimbal.

16. A floor treating machine including a brush drive motor, a floor treating brush for rotation about a generally vertical axis and means operably connecting said brush to said brush drive motor, the improvement in said floor treating machine comprising said means operably connecting said brush to said brush drive motor including: a motor gimbal having a convex exterior bottom surface, said exterior bottom surface having a radius of curvature; means operably connecting said motor gimbal to said drive motor; a brush gimbal; means mounting said brush gimbal on said floor treating brush; said brush gimbal including a cavity in the upper exposed surface thereof, said cavity having a bottom interior surface which has a radius of curvature; means releasably securing said brush gimbal to said motor gimbal with said motor gimbal seated in said brush gimbal cavity; means on said motor gimbal and on said brush gimbal fixing the same against rotation relative to one another such that they rotate together when said drive motor is operated; said bottom exterior surface of said motor gimbal having a radius of curvature less than the radius of curvature of the bottom interior surface of said brush gimbal whereby as said floor treating machine traverses a surface being cleaned, said floor treating brush is free to shift its axis of rotation vis-a-vis the axis of rotation of said motor gimbal, and wherein said motor gimbal includes an interior solution cavity with holes passing therefrom to the exterior of said motor gimbal; said brush gimbal including holes passing from the interior cavity to the exterior thereof and to the bristles of said brush whereby solution is fed to said solution cavity of said motor gimbal and thence to said interior cavity of said brush gimbal and thence to the bristles of said brush.

* * * * *